US012041990B2

(12) United States Patent
Thibodeau

(10) Patent No.: US 12,041,990 B2
(45) Date of Patent: Jul. 23, 2024

(54) FLUID MANAGEMENT SYSTEM

(71) Applicant: MAINE-LEE TECHNOLOGY GROUP LLC, Portland, ME (US)

(72) Inventor: Lee Thibodeau, Cumberland Foreside, ME (US)

(73) Assignee: MAINE-LEE TECHNOLOGY GROUP LLC, Portland, ME (US)

( * ) Notice: Subject to any disclaimer, the term of this patent is extended or adjusted under 35 U.S.C. 154(b) by 0 days.

(21) Appl. No.: 17/450,125

(22) Filed: Oct. 6, 2021

(65) Prior Publication Data

US 2022/0061428 A1 Mar. 3, 2022

Related U.S. Application Data

(63) Continuation-in-part of application No. 17/275,760, filed as application No. PCT/US2020/048052 on Aug. 26, 2020, now abandoned.

(Continued)

(51) Int. Cl.
*A41D 27/10* (2006.01)
*A41D 13/12* (2006.01)

(Continued)

(52) U.S. Cl.
CPC ..... *A41D 13/1227* (2013.01); *A41D 19/0048* (2013.01); *A41D 27/10* (2013.01); *A41D 31/125* (2019.02)

(58) Field of Classification Search
CPC ..... A41D 13/1227; A41D 19/0048; A41D 27/10; A41D 31/125
See application file for complete search history.

(56) References Cited

U.S. PATENT DOCUMENTS 3,099,015 A 7/1963 Renehan
4,114,200 A 9/1978 Smith et al.

(Continued)

FOREIGN PATENT DOCUMENTS

WO WO 2021/041578 A1 3/2021

OTHER PUBLICATIONS

International Search Report with Written Opinion, mailed Nov. 9, 2020, received in international patent application No. PCT/US2020/048052, 8 pages.

(Continued)

*Primary Examiner* — Sally Haden
(74) *Attorney, Agent, or Firm* — Duane Morris LLP

(57) ABSTRACT

A fluid management system includes a sleeve member having a first end, a second end, an interior surface, and an exterior surface. The first end of the sleeve member is proximate a distal end of the gown sleeve and the second end extends inside of the distal end of the gown sleeve. A portion of the exterior surface of the sleeve member proximate the second end is in contact with a portion of an interior surface of the gown sleeve. There is a cuff member having a first end, a second end, an interior surface, and an exterior surface. The interior surface faces and is moveable with respect to portions of the exterior surface of the sleeve member/gown sleeve to enable the insertion of a cuff ring of the protective glove between interior surface of the cuff member and the exterior surface of one of the sleeve member/gown sleeve.

20 Claims, 11 Drawing Sheets

Related U.S. Application Data

(60) Provisional application No. 62/943,986, filed on Dec. 5, 2019, provisional application No. 62/899,937, filed on Sep. 13, 2019, provisional application No. 62/891,733, filed on Aug. 26, 2019.

(51) Int. Cl.
*A41D 19/00* (2006.01)
*A41D 31/12* (2019.01)

(56) References Cited

U.S. PATENT DOCUMENTS 4,389,734 A * 6/1983 Franz ..... A41D 13/1227 2/60
5,444,871 A 8/1995 Lopez
5,572,743 A 11/1996 Yavitz
5,749,098 A * 5/1998 Evans ..... A41D 19/0041 2/124
6,092,237 A * 7/2000 Baldwin ..... A41D 19/0089 2/60
7,302,711 B1 12/2007 Tanenbaum
7,448,093 B1 * 11/2008 Ruck ..... A62B 17/001 2/457
7,647,648 B2 * 1/2010 Komorowski ..... A41D 13/0012 2/69
2008/0092280 A1 4/2008 Johnson et al.
2008/0155728 A1 * 7/2008 Hafer ..... A41D 27/245 2/69
2018/0092412 A1 4/2018 Genender
2018/0343940 A1 * 12/2018 Genender ..... A41D 13/1236

OTHER PUBLICATIONS

AORN Safe Surgery Together, Periop Insider: 2018 Articles: Glove-Gown Fluid Exposure: Know the Risks; Published Mar. 7, 2018; retrieved from the Internet <URL: https://www.aorn.org/about-aorn/aorn-newsroom/periop-insider-newsletter/2018/2018-articles/glove-gown-fluid-exposure-know-the-risks>.

Zafer Kahveci, F. Selcen Kilinc-Balci & Patrick L. Yorio (2019) Critical investigation of glove-gown interface barrier performance in simulated surgical settings, Journal of Occupational and Environmental Hygiene, 16:7, 498-506, DOI: 10.1080/15459624.2019.1600702.

International Search Report with Written Opinion, mailed Jan. 27, 2023, received in international patent application No. PCT/US22/45906052, 10 pages.

* cited by examiner

FLUID MANAGEMENT SYSTEM

CROSS-REFERENCE TO RELATED APPLICATIONS

This application is a continuation-in-part of U.S. patent application Ser. No. 17/275,760, filed Mar. 12, 2021, which is a U.S. National Stage of International Application No. PCT/US2020/048052, entitled "FLUID MANAGEMENT SYSTEM", filed Aug. 26, 2020, which claims the benefit of priority to U.S. Provisional Application No. 62/891,733, filed Aug. 26, 2019, entitled "MOISTURE20 MANAGEMENT SYSTEM", U.S. Provisional Application No. 62/899,937, filed Sep. 13, 2019, entitled "FLUID MANAGEMENT SYSTEM", and U.S. Provisional Application No. 62/943,986, filed Dec. 5, 2019, entitled "FLUID MANAGEMENT SYSTEM", all of which are incorporated herein by reference in their entirety.

FIELD OF THE INVENTION

The invention is directed to a fluid management system for the interface between the sleeve of a protective gown and the cuff of protective glove to prevent fluid, such as perspiration from the skin of the user, collecting at the gown/glove interface, as well as to prevent fluids from the outside environment penetrating the gown/glove interface and coming into contact with the skin of the user.

BACKGROUND OF THE INVENTION

As the literature well describes, there is a "weak link" in the barrier between the user and their external environment with personal protective equipment (PPE) used in a surgical setting at the interface between the sleeve of a protective gown and the cuff of protective glove. Without an adequate barrier, the passage of fluids, such as perspiration, from the user's skin to the outside sterile environment may occur, contaminating the environment. In addition, fluids such as blood or other bodily fluids may pass through the interface from the outside environment and make contact with the user's skin.

Collection of perspiration between the sleeve of protective gown and the cuff of a protective glove, in a surgical setting, results in discomfort for the surgeon and increases the risk of breaking sterile technique. Perspiration from the gloved hand/wrist follows the knitted cuff at the distal end of the sleeve of a surgical gown and results in the collection or pooling of moisture between the impervious (waterproof) surgical gown and the cuff of the surgical glove, which is also waterproof.

With pooled moisture (perspiration) between the surgical gown and the cuff of the surgical glove, one cannot change the position of the glove without a break in sterile technique. Therefore, the user's hand and arm can become very uncomfortable in order to avoid breaking the sterile environment.

Fluid leakage from the outside environment to the skin of the user at the glove/gown interface is also very important problem for surgical and perioperative professionals because direct contact with blood or body fluids can be life threatening, especially when caring for patients with infectious diseases, such as Hepatitis C, HIV, and viral hemorrhagic fevers such as Ebola. Also, contamination of hands and wrists can lead to colonization with drug-resistant bacteria or other germs that could be harmful to patients.

Then the glove rolls down or slips on the sleeve, the risk of exposure to blood or body fluids increases. When gloves are pulled up over the wide and baggy cuff and sleeve of the gown, this also creates an exposure risk. An effect called "channeling" can occur when body fluids seep between the inner surface of gloves and the outer surface of the sleeve toward wrists and hands. Glove "roll-down" or slippage can result from a low frictional interface between the interior side of the glove and the surgical gown sleeve. Thus, there is a strong need for an improved glove/gown interface in the surgical setting.

There are other non-surgical applications where similar problems may arise. These include, but are not limited to, laboratories, clean rooms, and emergency rooms, as well as in food, chemical, and hazardous material handling, which would also benefit from an improved glove/gown interface.

BRIEF SUMMARY OF THE INVENTION

The benefits and advantages of the present invention over existing systems will be readily apparent from the Brief Summary of the Invention and Detailed Description to follow. One skilled in the art will appreciate that the present teachings can be practiced with embodiments other than those summarized or disclosed below.

In one aspect, the invention includes a fluid management system for the interface between a sleeve of a protective gown and a protective glove. The fluid management system includes a sleeve member having a first end, a second end, an interior surface, and an exterior surface. The first end of the sleeve member is proximate a distal end of the sleeve of the protective gown and the second end of the sleeve member extends inside of the distal end of the sleeve of the protective gown. A portion of the exterior surface of the sleeve member proximate the second end is in contact with a portion of an interior surface of the sleeve of the gown. There is a cuff member having a first end, a second end, an interior surface, an exterior surface. The interior surface of the cuff member faces and is moveable with respect to portions of the exterior surface of one or both of the sleeve member and the sleeve of the protective gown to enable the insertion of a cuff ring of the protective glove between interior surface of the cuff member and the exterior surface of one of the sleeve member or the sleeve of the protective gown.

In other aspects of the invention, one or more of the following features may be included. The cuff member may include a retention member to secure the cuff ring of the protective glove in place between the interior surface of the cuff member and the exterior surface of one of the sleeve member and the sleeve of the protective gown. The interior surface of the sleeve member may comprise a moisture wicking material and the exterior surface of the sleeve member may comprise an impervious material. The interior surface and the exterior surface of the sleeve of the protective gown each may comprise an impervious material. The interior surface of the cuff member may face and be moveable with respect to the exterior surface of both of the sleeve member and the sleeve of the protective gown. The first end of the cuff member may be affixed to the first end of the sleeve member and may be foldable onto the portions of the exterior surfaces of both of the sleeve member and the sleeve of the protective gown. The sleeve member may extend beyond and outside of the distal end of the sleeve of the protective gown. The cuff ring of the protective glove may be sandwiched between retention member of cuff member and the exterior surface of the sleeve of the protective gown. Proximate where the first end of the cuff member is affixed to the first end of the sleeve member there may be included a dead space between the interior surface of the cuff member and the exterior surface of the sleeve member to trap leaked fluid.

In yet other aspects of the invention, one or more of the following features may be included. The cuff member may be formed by the distal end of the sleeve of the protective gown and the distal end of the sleeve of the gown may be folded onto only the exterior surface of the sleeve of the gown proximate the first end of the sleeve member. The cuff ring of the protective glove may be sandwiched between retention member on the distal end of the sleeve of the protective gown and the exterior surface of the sleeve of the protective gown. Proximate where the distal end of the sleeve of the gown is folded onto only the exterior surface of the sleeve of the gown there may be included a dead space between the exterior surface of the cuff member and the exterior surface of the sleeve member to trap leaked fluid. The cuff member may be formed by the distal end of the sleeve of the protective gown and the sleeve member may extend beyond and outside of a distal end of the sleeve of the protective gown. The cuff ring of the protective glove may be sandwiched between the distal end of the sleeve of the protective gown and the exterior surface sleeve member. The cuff ring of the protective glove may abut the retention member and the retention member may be spaced a distance from the distal end of the sleeve of the protective gown and laminated between the interior surface of the sleeve of the protective gown and the exterior surface of the sleeve member. The sleeve member and the cuff member may be tubular in shape.

These and other features of the invention will be apparent from the following detailed description and the accompanying figures.

DETAILED DESCRIPTION OF THE INVENTION

Figure 1A:
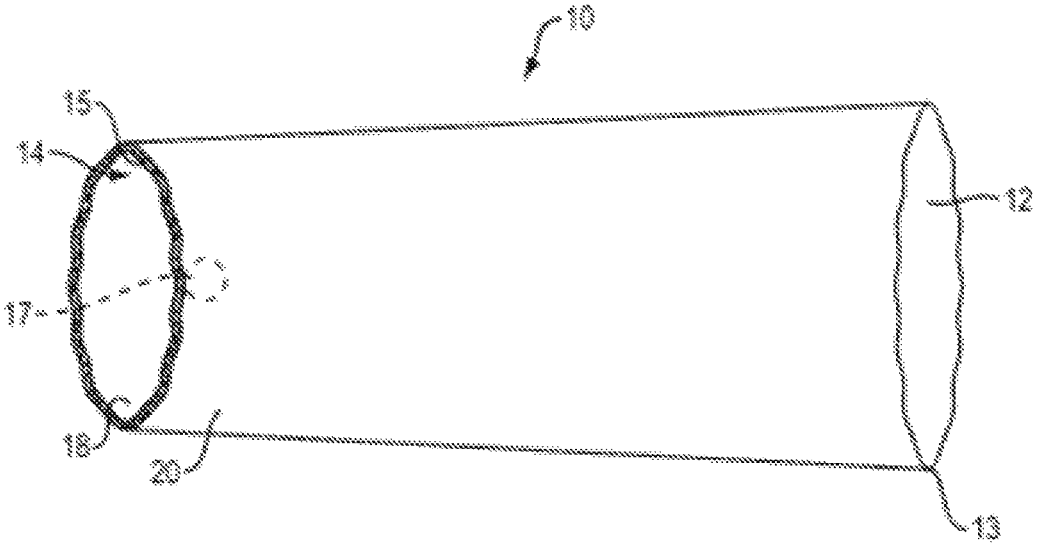
FIG. 1A is a perspective view of an embodiment of a sleeve member according to an aspect of the disclosure.

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments, as the skilled artisan would recognize, even if not explicitly stated herein. Any dimensions included in the figures or used herein are merely exemplary and not limiting.

Descriptions of well-known components and processing techniques may be omitted to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it should be noted that while an aspect of the invention is described herein in connection with a surgical glove and a surgical gown, the invention is not limited and it may be used in other applications, e.g. food, chemical, hazmat, laboratories, clean rooms, and emergency rooms, and the concepts may be applied to other articles of protective gear.

The use of wicking sleeve to decrease accumulation of moisture/fluid between the sleeve of protective gown (e.g. a surgical gown) and the cuff of a protective glove (e.g. a surgical glove) is described below. This aspect of the invention, may be used alone or, in combination with other components, to a form fluid management system for the interface between the sleeve of a protective gown and the cuff of protective glove to prevent both perspiration collecting at the gown/glover interface, as well as to prevent fluids from the outside environment penetrating the gown/glove interface and coming into contact with the skin of the person wearing the gown/glove.

Figure 1B:
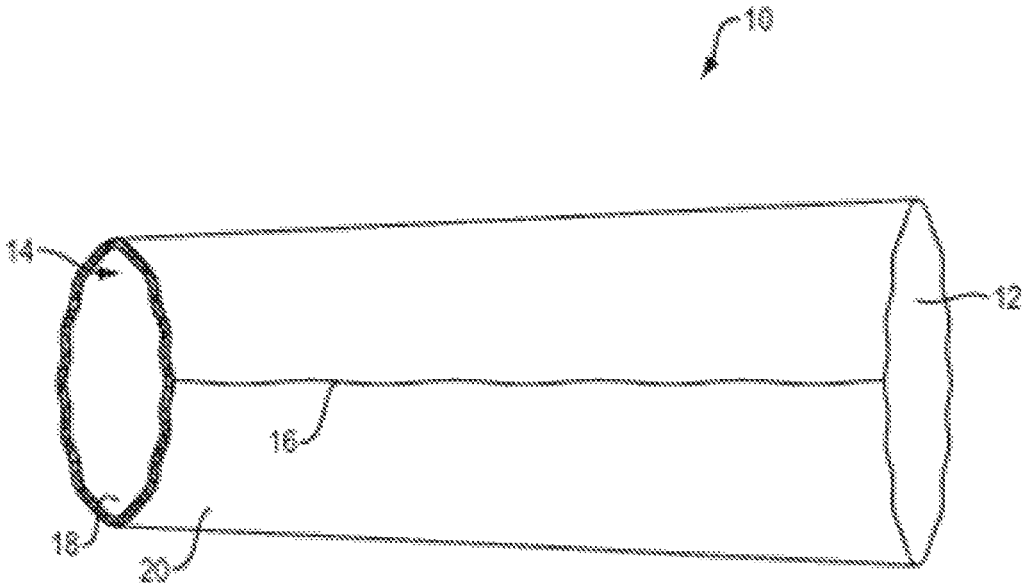
FIG. 1B is an alternate perspective view of the sleeve member shown in FIG. 1A.
Figure 2A:
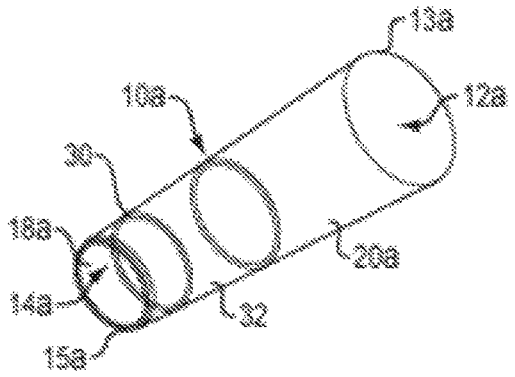
FIG. 2A is a perspective view of another embodiment of a sleeve member according to an aspect of the disclosure.
Figure 2B:
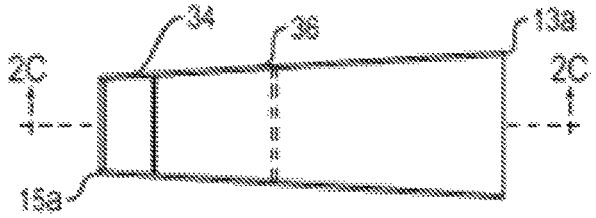
FIG. 2B is a side elevational view of the sleeve member shown in FIG. 2A.
Figure 2C:
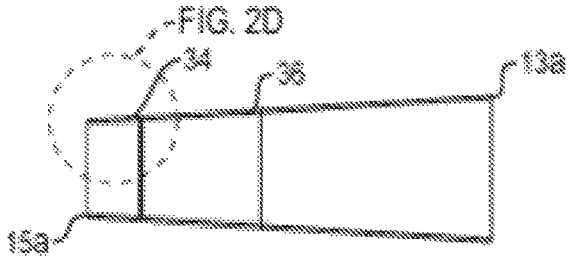
FIG. 2C is a cross sectional view of the sleeve member shown in FIG. 2B taken along lines A-A.
Figure 2D:
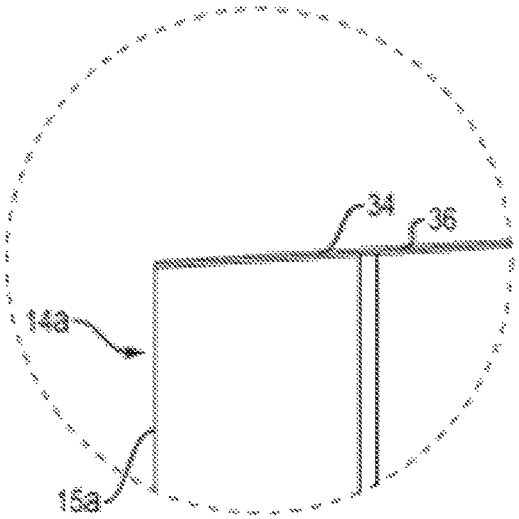
FIG. 2D is an enlarged view of area B of the sleeve member shown in FIG. 2C.

The sleeve 10, according to an aspect of the disclosure, is shown in FIGS. 1A and 1B. Sleeve 10 may be tubular in shape and may include a moisture/fluid management material, such as a wicking material. Sleeve 10 may include a forearm opening 12 and a wrist opening 14, and a user's hand may be inserted into the forearm opening 12 and out through the wrist opening 14 so that the sleeve is worn by the user on their forearm. At each opening, there may be included elastic stitching bands, such as band 13 around the circumference of forearm opening 12 and band 15 around the circumference of wrist opening 14, to ensure a secure fit for sleeve 10 when donned on a user's forearm. The sleeve may optionally include an opening 17 for a user's digit (e.g.

a thumb) to secure the wrist opening 14 of sleeve 10 in a position about the user's palm to be well positioned to absorb perspiration.

The forearm opening 12 is larger-in-size than the wrist opening to accommodate the larger diameter of a user's forearm as compared to the user's wrist. The size of the openings and the length of the sleeve may be made of various sizes to accommodate various size users or as a "one size fits all."

Sleeve 10 may be formed by taking a flat piece of material 20 and rolling it into a tubular shape, Which may then be sewn at both ends with an Elastane thread 16, for example, or affixed using a binder material. The flat piece of material may be formed of multiple layers of material including moisture wicking material on one side of the fabric and an impervious material on the opposite side, for example. When rolled the moisture wicking material may be disposed on the interior surface 18 of tubular sleeve 10 and the impervious material on the exterior surface of the sleeve 10, forming a dual layer sleeve.

The sleeve 10 may be made as independent article, which is free of the sleeve of the protective gown/garment, or it may be affixed in one or more places to the gown/glove. The sleeve 10 may, alternatively, be formed as an integral part of the sleeve of protective gown/garment. Also, a full sleeve need not be used and instead one or more strips or other structure structures may be used.

An alternative embodiment of the sleeve according to an aspect of this disclosure is depicted as sleeve 10*a* in FIGS. 2A-2D. Like sleeve 10, sleeve 10*a* may be tubular in shape and may include a forearm opening 12*a*, a wrist opening 14*a*. A user's hand may be inserted into the forearm opening 12*a* and out through the wrist opening 14*a* so that the sleeve is worn by the user on their forearm. At each opening, there may be included elastic stitching bands, such as band 13*a*, around the circumference of forearm opening 12*a* and band 15*a*, around the circumference of wrist opening 14*a*, to ensure a secure fit for sleeve 10*a* when donned on a user's forearm. The sleeve may optionally include an opening (not shown) for a user's digit (e.g. a thumb) to secure the wrist opening 14*a* of sleeve 10*a* in a position about the user's palm to be well positioned to absorb perspiration.

Sleeve 10*a* may include additional elastic banding/stitching rings 30 and 32 about the circumference of sleeve 10*a* positioned between forearm opening 12*a* and wrist opening 14*a*. These banding rings may be used to form the cuff member described below and used to hold in place a cuff ring of a protective glove. For example, portion 34 of sleeve 10*a* may be folded over to overlay portion 36 to form a cuff member with the exterior impervious layer of portion 34 facing and in contact with the exterior impervious layer of portion 36. A cuff ring of a protective glove may be inserted into the cuff member formed by portion 34 folded on to portion 36, as is described in FIG. 3, for example.

The of the fluid management system according to aspects of the disclosure may be deployed in multiple versions. Three possible examples include but are not limited to:

1. The sleeve of the fluid management system can be self-contained and separate from the gown/garment. For example, a sleeve containing the moisture management fiber/material.
2. The sleeve of the fluid management system may be attached to the inner surface of the gown/garment and may be in the form of a strip, band, circumferential sleeve, or some other shape/configuration.
3. The sleeve of the fluid management system may be incorporated into the gown/garment as an integral part/component/layer of the gown/garment. For example, a moisture wicking laminate or layer on the inner surface of the gown/garment.

The sleeve of the fluid management system may use textiles that may be worn on all extremities of the body including, but not limited to between the hand/wrist and forearm. The sleeve of the fluid management system may be made of knit, woven, non-woven, ultrasonic bonded, welded or heat-sealed material. The sleeve of the fluid management system may be made of natural or synthetic fibers or blends thereof. Each side of the system may be made with or without coatings or films. For example, a laminated material may be used with one side having its own fluid management system, while the outside may be impervious. In all cases, whether formed of natural or synthetic materials, the textile fluid management system may be composed of highly wicking material with high moisture pick-up capability.

The natural or synthetic materials of the sleeve of the sleeve of the fluid management system may include additives, including but not limited to organic material, nanoparticles of various types, chemicals, heavy or light metals, waxes, water based anti-microbial(s), including but not limited to chitosan.

The sleeve of the fluid management system may take a multitude of configurations, such as a one-piece tubular sleeve or a single piece flat fabric that, through an attachment process, may be located appropriately on the hand/wrist. Either of these or other configurations can be independent from and/or part of the surgical/protective gown/garments. The sleeve of the fluid management system may be used in the form of other types of garments or sleeves to be worn/applied/used in connection with various parts of the body and various garments.

The following are some exemplary features and benefits of the fluid management system according to aspects of the disclosure:

- The creation of a moisture management zone that is independent of and/or an integral part of the surgical/protective gown/garment.
- The creation of an impervious side independent of the surgical/protective gown.
- The creation of an independent pathway for moisture that restricts the movement of moisture from the inside of the surgical/protective sleeve to that of the outer layer surgical protective gown.
- The creation of a material reservoir that collects moisture from the skin in contact with the surgical/protective glove that allows for transportation (vertical wicking) away from the surgical/protective glove zone.
- The creation of a material pathway for moisture to flow from the reservoir to the extremities away from the surgical/protective glove zone where evaporation takes place.
- The creation of a mini-environment that decreases the opportunity for infection to migrate away from the moisture management zone closest to the skin.
- Utilizes fibers and chemical means to create a mini-environment that effectively enhances moisture management to take place.
- To increase the comfort of the user by creating a dryer environment within and between the glove and the hand.
- The creation of multiple environments within the surgical/protective glove/sleeve/gown/garment to work together as one master system that manages moisture, comfort, temperature, evaporation and infection within the protective gown/garment.

The drawings (FIGS. 1A and 1B below) depict two views of one exemplary embodiment, which is in the form of a protective sleeve to be worn on the forearm of a user under the distal end of the sleeve of a protective gown, such as a surgical gown. The protective sleeve may be formed of any material suitable for this application, as described above, and it may be positioned proximate the interface between a protective gown and a protective glove to decrease accumulation of moisture between the sleeve of protective gown and the cuff of a protective glove. The ends of the flat material may be connected by sewing/stitching, by gluing, or by any other suitable means of affixing the ends of the material.

Figure 3:
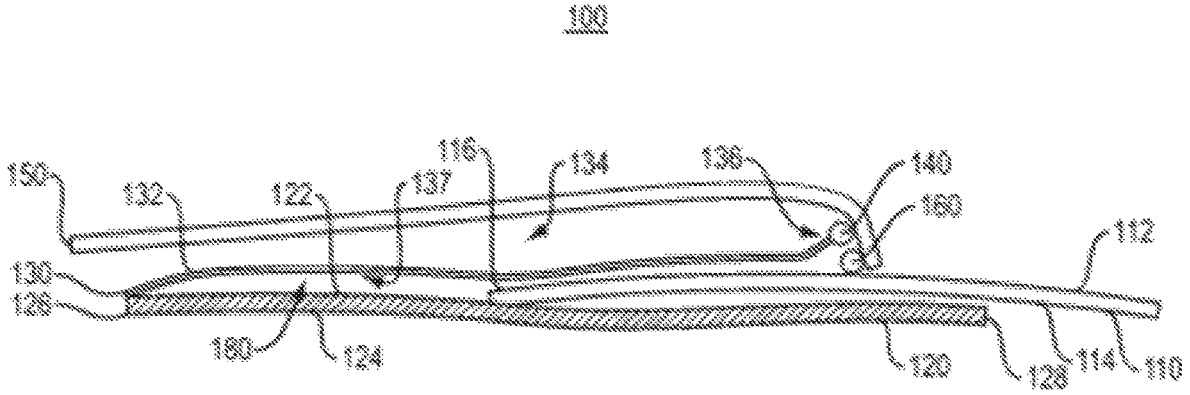
FIG. 3 is a cross-sectional view of a fluid management system according to an aspect of the disclosure.

An embodiment of a fluid management system 100 according to an aspect of this disclosure is shown in FIG. 3. This fluid management system provides both a moisture management function as well as a complete barrier between the user and their external environment. Thus, the system prevents fluids (i.e. perspiration) from travelling from the inside gown/glove to the outside environment and it prevents fluids in the outside environment from penetrating the glove/gown interface and reaching the user's skin.

As shown in FIG. 3, fluid management system 100 is composed of a lamination of three layers. The first layer is the distal end of the impervious surgical gown sleeve 110, which has an exterior surface 112 facing the outside environment and an interior surface 114 facing and in contact with the user. Under the surgical gown sleeve 110, and in contact with at least a portion of interior surface 104 of the surgical gown sleeve 110, is the moisture management/wicking sleeve member 120, which lies directly on the surface of the wearer's hand/wrist. Sleeve member 120 may be comparable to sleeves 10/10*a* described above in FIGS. 1 and 2, which may be constructed as a dual layer sleeve having an exterior surface 122 formed of an impervious material and an interior surface formed of 124 formed of a moisture wicking material. When the glove 150 is donned and the user perspires, the wicking layer of layer 124 moves moisture from the inside of the inner glove into the sleeve/arm area under the surgical gown.

Wicking sleeve member 120 will typically extend a sufficient distance up the gown sleeve 110 to ensure that perspiration will not be transferred out to the exterior of the surgical gown sleeve 110.

In this embodiment, there may be an impervious member 130, which may be affixed at its first or distal end 132 to the first end 126 of the sleeve member 120. The second end 128 of sleeve member terminates in the interior region of surgical gown sleeve 110. The first or distal end 132 of impervious member 130, which is affixed to a top surface of the first/distal end 126 of the sleeve member 120, extends along and over/facing the top surface 122 of the sleeve member 120 and a portion of outer surface 112 of the impervious gown sleeve 110. The impervious member 130 forms a cuff member 134, which terminates at its second or proximal end 136. The cuff member 134 overlays and is in contact with the distal end 116 of the impervious surgical gown sleeve 110. Thus, the distal end 116 of the impervious surgical gown sleeve 110 is sandwiched between the exterior surface 122 of sleeve member layer 120 (on the bottom) and interior surface 137 of the impervious member 130 (on the top), forming the three-layer laminate.

At the second/proximal end 136 of the impervious member 130 there is affixed a retention member 140 (e.g. rim/band/strip), which may be similar to an O-ring or some other form of band or strip, and which has a level of stiffness, such that the cuff ring 160 of glove 150 may be affixed to it (i.e. by wrapping around a portion of the retention member 140) and allow the cuff ring on the end of the glove 150 to connect to/engage it to produce a "watertight seal" between the impervious gown sleeve 110 and the inner portion of glove 150. Retention member 140 may have a concave shape complementary to cuff ring 160 so that it may receive and engage cuff ring 160 to secure it in place when interlocked.

In the event there is leakage at the seal between the cuff ring 160 of glove 150 and cuff member 134 due to movement of the sleeve 110, for example, there is a dead space 180 between the cuff member 134 and the distal end of gown sleeve 110, which will trap leaked fluid.

Figure 4:
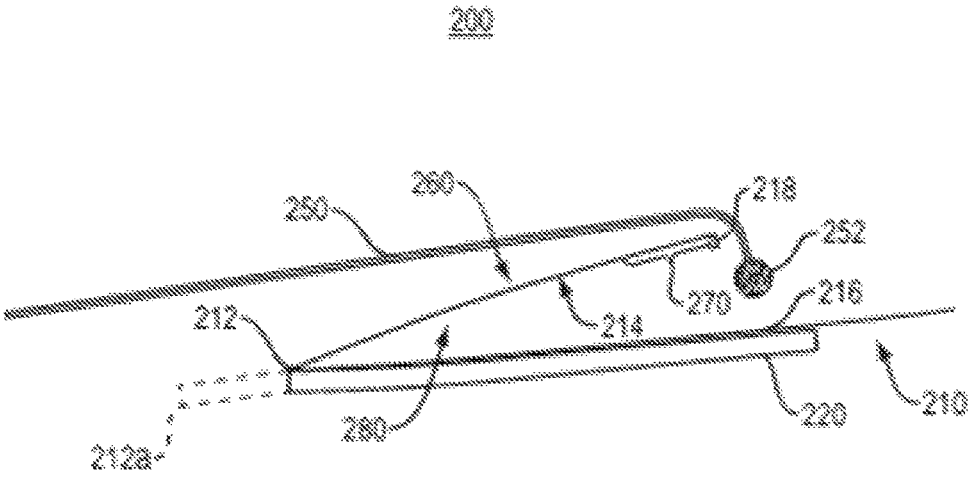
FIG. 4 is a cross-sectional view of another embodiment of the fluid management system according to an aspect of the disclosure.

In another embodiment of the disclosure, fluid management system 200 is shown in FIG. 4. In this embodiment, separate impervious layer 130 of FIG. 3 may be removed and, instead, the impervious surgical gown sleeve 210 may be folded back over itself at the first/distal end 212 to form gown sleeve portion 214, which faces and overlays gown sleeve portion 216, together forming cuff member 260.

At the second/proximal end 218 of the gown sleeve portion 214 there may be affixed a retention member 270, which may be like the retention member 140 at the proximal end of impervious layer 130 in FIG. 2. The cuff ring 252 of glove 250 may be inserted into the cuff 260 and affixed in place by the retention member 270 by wrapping the cuff ring 252 around a portion of the retention member 270 to allow the cuff ring 252 on the end of the glove 250 to connect to it to produce a "watertight seal." The cuff member 260 formed by gown sleeve portion 214 and gown sleeve portion 216 of impervious gown sleeve 210 are tightly sealed due to the elastic ring around the opening of gown sleeve 210 at end 218 causing the retention member 270 to be forced against the cuff ring 252 in turn sealing it against gown sleeve portion 216.

In the event there is leakage at the seal between the cuff ring 252 of glove 250 and cuff member 260 due to movement of the sleeve 210, for example, there is a dead space 280 between the cuff member 260 and the distal end of gown sleeve 210, which will trap leaked fluid. Also shown in this figure is the sleeve member 220, which may be affixed to the bottom surface of the gown sleeve 210 and terminate proximate the location where the cuff 260 is formed by folding the gown sleeve 210 over on itself, or it may extend beyond this point as indicated in phantom at 220*a*.

Figure 5:
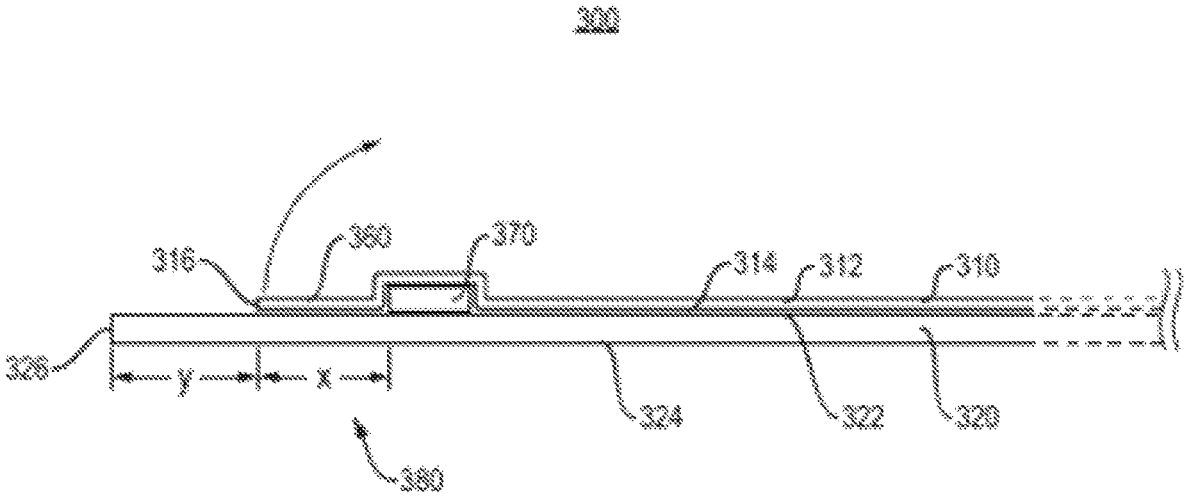
FIG. 5 is a cross-sectional view of yet another embodiment of the fluid management system according to an aspect of the disclosure.
Figure 6:
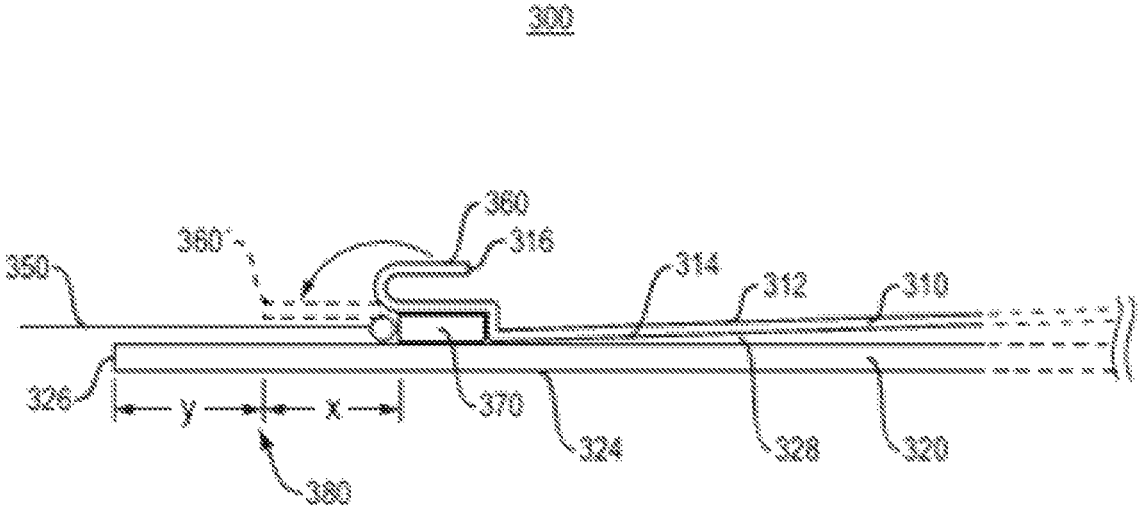
FIG. 6 is a cross-sectional view of yet another embodiment of the fluid management system according to an aspect of the disclosure without the protective glove depicted.

In yet another embodiment, fluid management system 300 is shown in FIGS. 5 and 6 to include impervious surgical gown sleeve 310 under which disposed and bonded thereto wicking layer or sleeve 320. Wicking layer or sleeve 320 may extend a portion of the distance up (but not normally the entire length of) the surgical gown sleeve 310. Wicking layer/sleeve 320 will typically extend a sufficient distance up the sleeve to ensure that perspiration will not be transferred out to the exterior of the surgical gown sleeve 10.

While the surgical gown sleeve 310 includes an impervious material on both the exterior surface 312 and the interior surface 314 thereof, the wicking layer or sleeve 320 may include an impervious material on the exterior surface 322, which will contact the interior surface 314 of the surgical gown sleeve 310 and also the surgical glove 350 when donned, as shown in FIG. 6. The interior surface 324 of wicking layer or sleeve 320 will include a wicking material.

Proximate the distal ends 316 and 326 of surgical gown sleeve 310 and the wicking layer or sleeve 320, respectively, and interposed between the two, may be affixed a retention member 370 (e.g. rim/band/strip). The composite of the surgical gown sleeve 310, wicking layer or sleeve 320, and the retention member 370 maybe formed by adhering the layers together using an adhesive, sonic or heat welding, sewing, or any other suitable means of adhering the items.

There is formed cuff member 360 out of the portion of the surgical gown sleeve 310 between the distal end 316 of surgical gown sleeve 310 and the rim/band/strip 370. There is also a cuff portion 380 formed proximate the first of distal end of wicking layer or sleeve 320. It should be noted that cuff member 360 and cuff portion 380 of the wicking layer 320 are not adhered together. The cuff member 360 and cuff portion 380 extend from the edge of retention member 370 to their respective distal ends.

As shown in FIG. 5, the interior surface of the cuff member 360 of surgical gown sleeve 310 is initially laying directly on the exterior surface of cuff portion 380 of wicking layer or sleeve 20. As can be seen in this view, the cuff portion 360 of the surgical gown sleeve 310 extends a distance X from the rim 370 to its distal end. And, cuff 380 of wicking layer or sleeve 320 extends the distance X and an additional distance Y from the rim 370 (total distance X+Y) to its distal end. In some cases, X may be different than Y. In one embodiment, X may be equal to Y and they may both equal approximately three (3) inches. In this example, cuff member 360 would extend three (3) inches from rim 370, while cuff portion 380 would extend six (6) inches from rim 370.

When the user desires to don the surgical gloves 350, the cuff portion 360 of the surgical gown sleeve 310 is folded onto itself over retention member 370 as shown in FIG. 6. The user then dons the surgical glove 350 such that it covers the exterior of the wicking layer 320 up to the rim 370. Shown in FIG. 6 in phantom is cuff 360' when it is moved back to its original position over the exterior of surgical glove 350. Thus, fluids from the exterior environment are prevented from penetrating to the user's skin and perspiration from the user is prevented from pooling up (as it is wicked away by wicking member/layer 320) and reaching the exterior environment resulting in loss of sterile environment.

Figure 7:
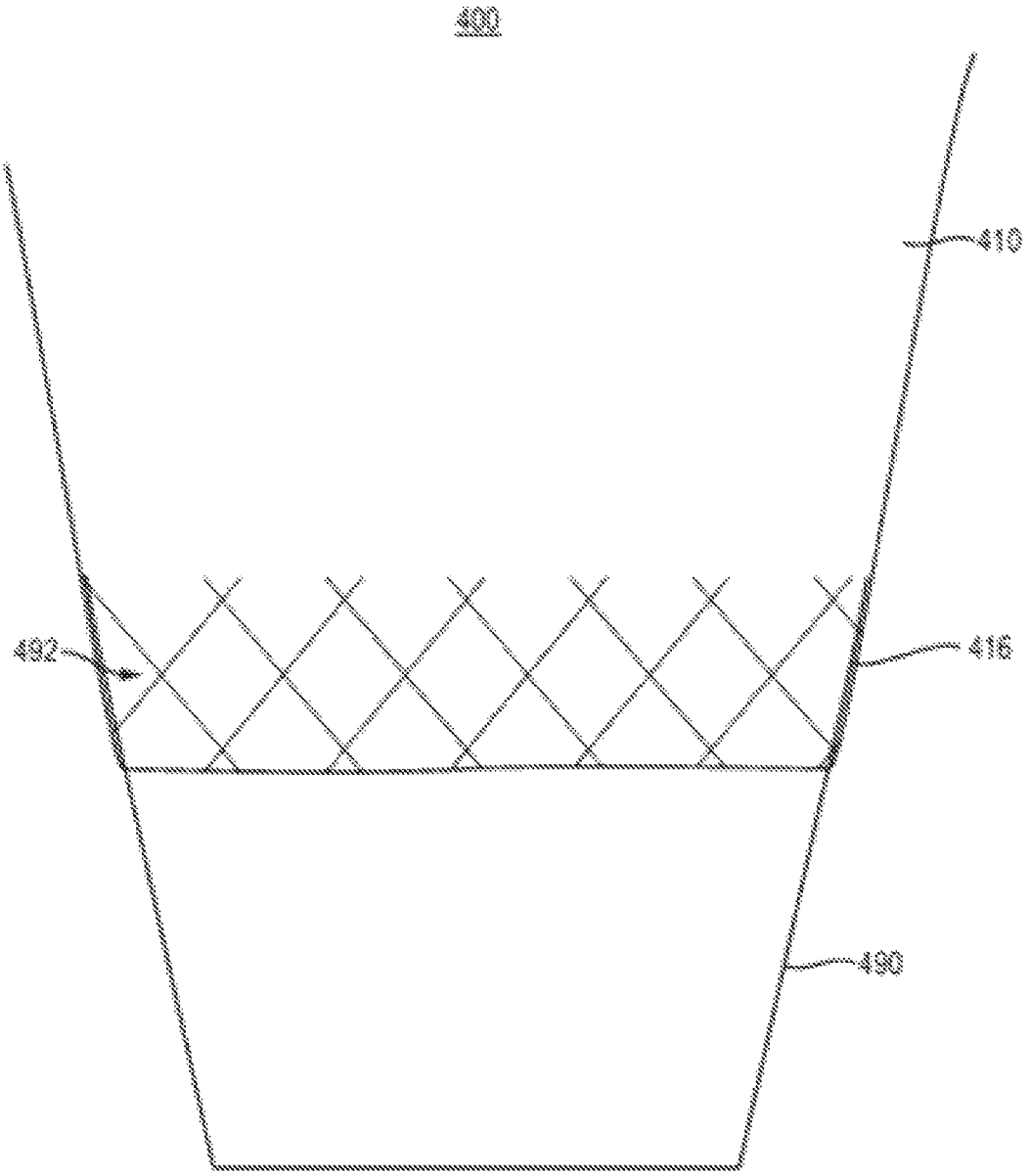
FIG. 7 is the cross-sectional view shown in FIG. 5 with protective glove depicted.

A further embodiment of the invention is depicted in FIG. 7 as fluid management system 400. System 400 is shown to include surgical gown sleeve 410 having a distal end 416. In the opening of gown sleeve 410 at distal end 416 is inserted rubber cuff 490, which may be welded to the interior surface of gown sleeve 410 in the region 492. This embodiment may be utilized with the above-described embodiments of FIGS. 3-6. In each of these embodiments the distal ends of the sleeve of the protective gown depicted as 110, 210, and 310, respectively, would be replaced by the rubber cuff 490.

Fluid Management Garment

In some embodiments, the fluid management system may be incorporated into a garment as an integral part/component/layer of the garment. For example, referring now to FIGS. 8 and 9A, a garment 500 having an integrated fluid management system can include a moisture wicking layer 503 generally positioned interior to an inner surface of a sleeve 501 of the garment 500.

Figure 8:
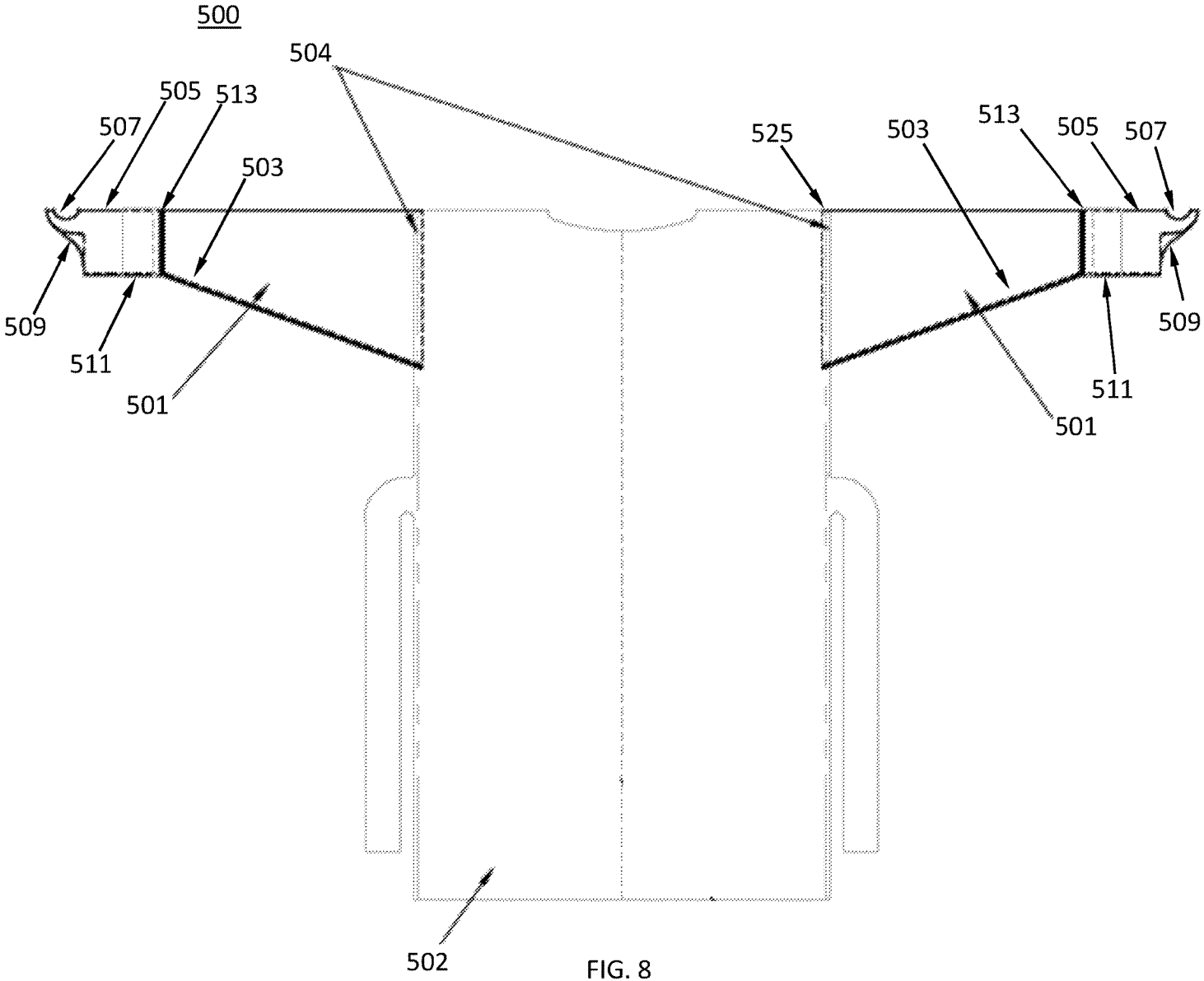
FIG. 8 is a cross-sectional view of a gown having an integrated fluid management system according to an aspect of the disclosure.

The garment 500, in accordance with various embodiments, can be any garment wherein fluid management is desirable, including, for example, surgical gowns, protective gear/garments for use in other industries and settings such as food preparation and processing, chemical, hazmat, laboratories, clean rooms, emergency rooms, athletic gear, or combinations thereof. As shown in FIG. 8, the garment 500 can be a surgical gown. Surgical gowns are typically disposable garments having sleeves and can be manufactured from impermeable or fluid-resistant fabrics including non-woven materials such as polypropylene, polyester, or polyethylene. In order to maintain impermeability, such garments are typically assembled by thermal (e.g., beat welding), chemical glues or other adhesives), or mechanical (e.g., adhesive tapes) seaming and not by sewing. Thus, the various components of the garment 500 (e.g., sleeves 501 and body 502) shown in FIGS. 8, 9A, and 9B can generally be attached by such seaming techniques, which will hereinafter be referred to as "welds" (e.g., shoulder weld 504 and cuff weld 513). For example, as shown in FIG. 8, the sleeves 501 of the garment 500 can be welded to a shoulder portion 525 of the garment 500.

Figure 9A:
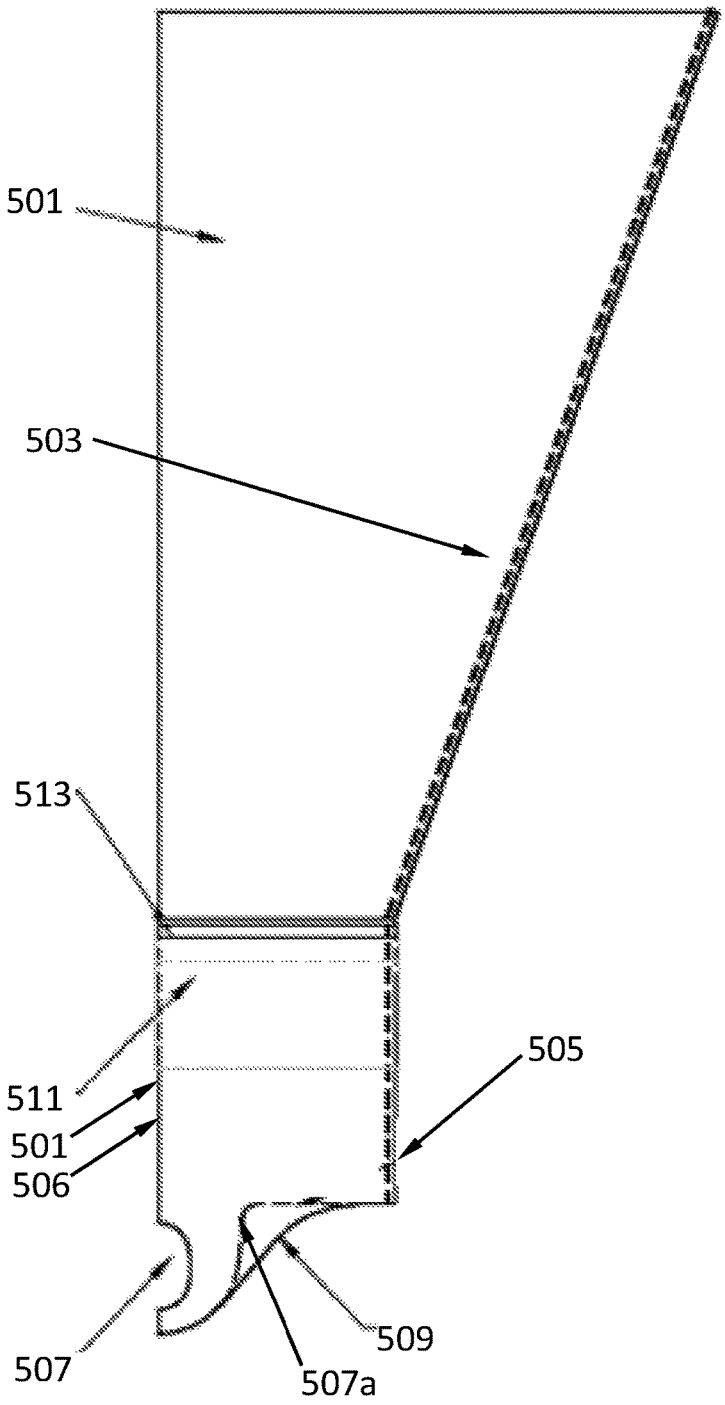
FIG. 9A is a cross-sectional view of a sleeve of the gown of FIG. 8 according to an aspect of the disclosure.

The wicking layer 503 can generally extend through at least a portion of the sleeve 501 of the garment 500. For example, as best shown in FIGS. 8 and 9A, in some embodiments the wicking layer can extend through the entire sleeve 501 of the garment 500, from the wrist all the way to the shoulder and even, in some embodiments, extending distally from the wrist to form a hand portion 505 having a thumb loop 507 and/or a palm draping 509 to further wick moisture form the hand area of the wearer. In other embodiments, the wicking layer 503 may only extend through a portion of the sleeve 501 and terminate at a different location such as, for example, on the wearer's forearm, similar to the wicking sleeves illustrated in FIGS. 1A-1B and 2A-2D.

Referring again to FIGS. 8 and 9A, the wicking layer 503 can be retained within the garment sleeve 501 by any suitable means capable of maintaining impermeability of the garment 500. For example, the wicking layer may be retained by either lamination or by more intermittent seaming welds as described above with reference to techniques including, for example, thermal (e.g., heat welding), chemical (e.g., glues or other adhesives), or mechanical (e.g., adhesive tapes) seaming. For example in some embodiments, the wicking layer 503 can be laminated along its entire surface to the interior of the sleeve 501. In other embodiments, the wicking layer 503 can be welded to the sleeve 501 in one or more locations such as, for example, the wrist, the shoulder, the elbow, the forearm, or combinations thereof. The wicking material of the wicking layer 503 can generally be any material suitable for transporting or pulling fluid through the fabric and away from the fluid source. Such materials can include, for example, polyester, polypropylene, merino wool, wool, bamboo, micromodal fabrics, nylon, and combinations thereof.

The hand portion 505 can generally extend distally from the wrist portion 506 of the sleeve 501. The hand portion can include a thumb loop 507 to provide stability and comfort in the hand area and/or a palm draping 509 to provide moisture management within surgical or other protective gloves by wicking moisture away from the hand area of the wearer. In some embodiments, the thumb loop 507 and palm draping 509 can be formed to provide wicking from the hand while preserving the fit and dexterity afforded by surgical gloves. As best shown in FIG. 9A, the thumb loop 507 can extend downward for insertion of the wearer's thumb. The palm draping 509 can preferably extend in a curvilinear manner between the thumb loop 507 and the wrist portion 506 which, in some embodiments, can be sized and shaped to cover the heel of the hand. In contrast, the thumb loop 507, on a side 507*a* opposite the palm draping 509 can extend directly (substantially straight) back to the wrist portion 506 in a proximal direction so as to leave the back of the hand free and to minimize volume inside the hand portion of the glove. Such a configuration can thereby provide wicking from the hand without negatively impacting fit, dexterity or freedom of hand movement of the wearer.

Figure 9B:
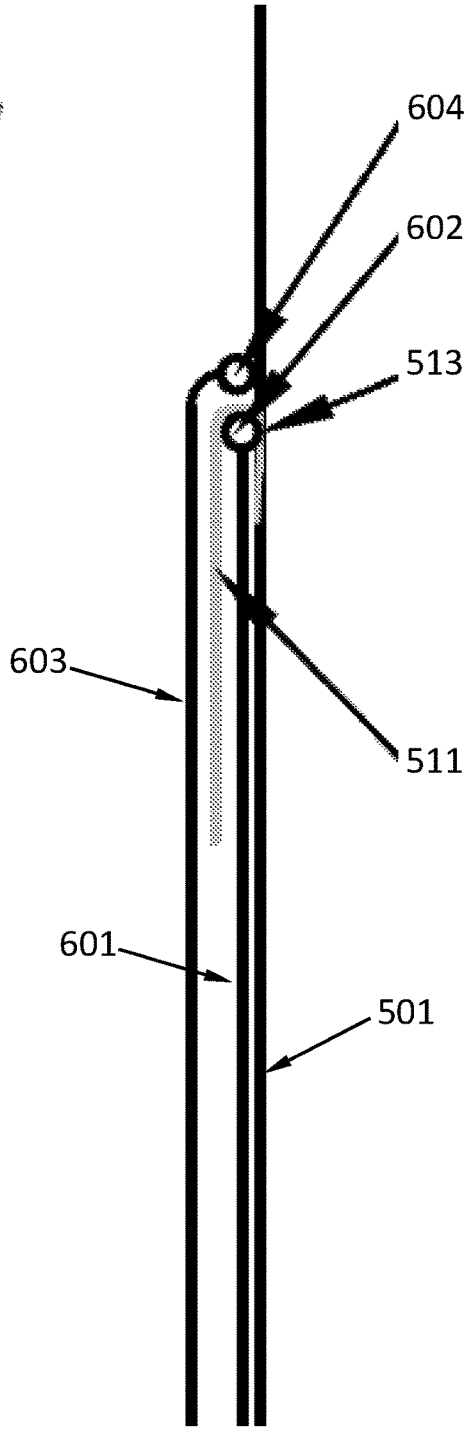
FIGS. 9B and 9C are a cross-sectional detail view of the sleeve of FIG. 9A with inner and outer gloves shown and not shown, respectively, according to an aspect of the disclosure.
Figure 9C:
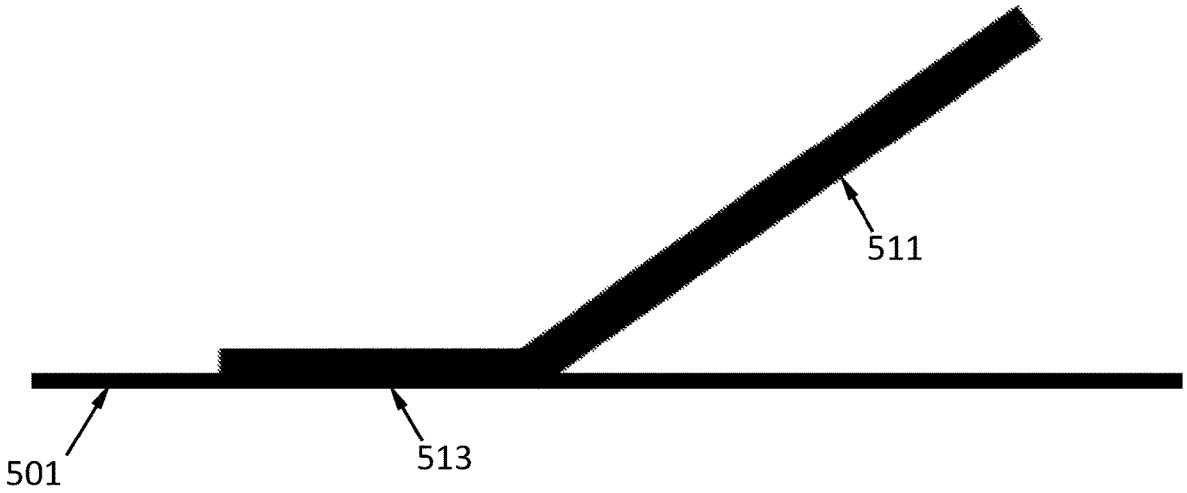

As best shown in FIG. 9B, the sleeve 501 of the garment 500 can include a cuff member ("flap") 511 attached thereto. In order to provide secure attachment and preserve impermeability of the garment, the flap 511 can be attached by a seaming cuff weld 513 constructed as described above with reference to techniques including, for example, thermal (e.g., heat welding), chemical (e.g., glues or other adhesives), or mechanical (e.g., adhesive tapes) seaming. The flap 511 can generally be attached at any location along the sleeve 501 suitable for turning the flap 511 down (distally) over the proximal end of a glove 601 (e.g., over the o-ring 602 of a surgical glove) to retain the glove in place and to prevent moisture ingress or egress.

Still referring to FIG. 9B, in many applications both an inner glove 601 and outer glove 603 may be worn. In such embodiments the proximal end and o-ring 602 of the inner glove 601 may be positioned between the flap 511 and the sleeve 501 of the garment 500 to retain the glove in place and to prevent moisture ingress or egress via, for example, channeling. The proximal end of the outer glove(s) 603 may be positioned exterior to the flap 511. In such embodiments it may be preferable to position an o-ring 604 of the outer glove(s) 603 proximal to the seaming weld 513 such that an interaction of the o-ring 604 with the joint between the flap 511 and the weld 513 to further retain the glove 603.

In some embodiments, the flap 511 can be constructed from a same material as the sleeve 501 of the garment 500. In some embodiments, the flap 511 can be constructed of a different material such as, for example, a higher-friction material in order to further prevent slipping of the gloves 601, 603 relative to the exterior of the sleeve 501. Suitable higher friction materials can include, for example, Thermoplastic Polyurethane (TPU), rubber, or any other suitable impermeable material having a higher coefficient of friction than the material of the sleeve 501.

Figure 10A:
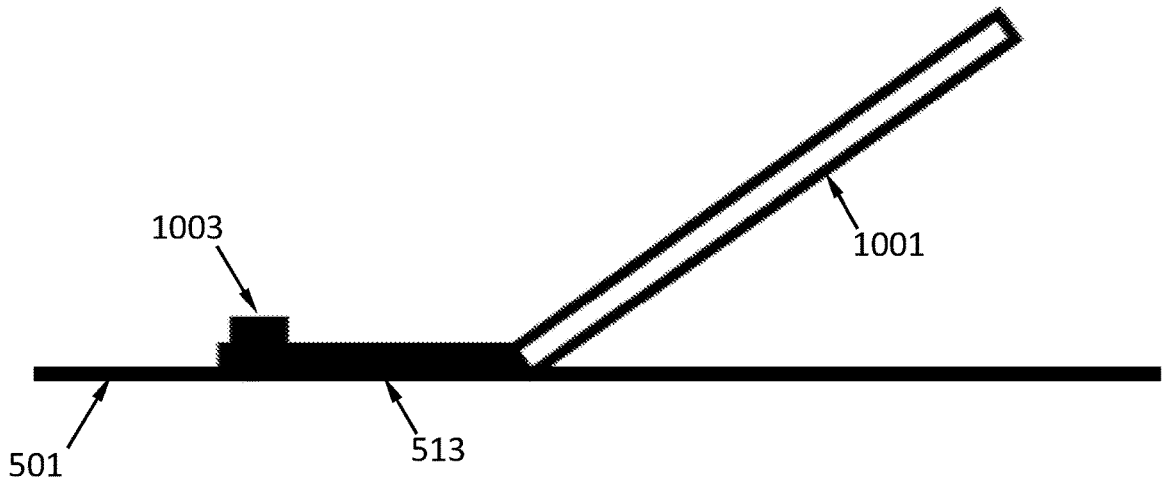
FIG. 10A is a cross-sectional view of a glove retention feature of a gown having an integrated fluid management system according to an aspect of the disclosure.
Figure 10B:
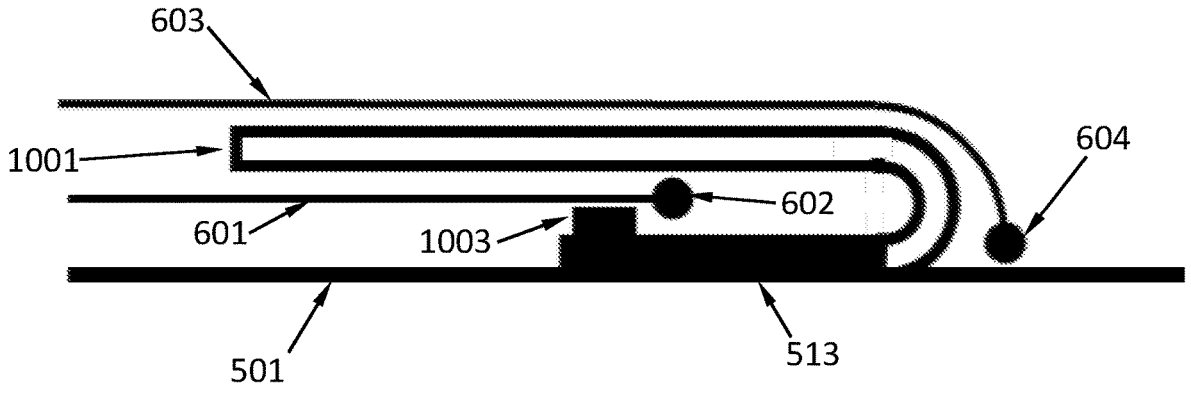
FIG. 10B is a cross-sectional view of the glove retention feature of FIG. 10A deployed to retain gloves according to an aspect of the disclosure.

In some embodiments, as shown in FIGS. 10A-10B, a filled flap 1001 can be provided to provide greater stiffness and a more compressive fit to better hold the inner glove 601 and the o-ring 602 of the inner glove 601 against the sleeve 501. In addition, the filled flap 1001 can also better capture the o-ring 604 of the outer glove(s) 603 when the o-ring 604 of the outer glove(s) 603 is positioned proximal to a joint between the weld 513 and the filled flap 1001 because the filled flap 1001 results in a larger/thicker protrusion at the joint. In such embodiments the flap 1001 can be filled with any suitable fluidic material including, for example, gases such as air or nitrogen, liquids such as water or saline. Although it will be apparent in view of this disclosure that the filled flap 1001 can be filled to any desired pressure, the flap may, in some embodiments, preferably be filled to a pressure high enough to enhance compression of the inner glove 601 and the o-ring 602 of the inner glove 601 against the sleeve 501 and low enough to permit turning the filled flap 1001 down (distally) over the proximal end of the inner glove 601 (e.g., over the o-ring 602 of the inner glove 601) to retain the inner glove 601 in place and to prevent moisture ingress or egress.

Still referring to FIGS. 10A and 10B, further retention of the inner glove 601 can be provided by a ridge 1003 extending around a distal portion of the weld 513 in order to provide resistance to distal roll-back or slippage of the o-ring 602 of the inner glove 601. This resistance to distal roll-back or slippage works in cooperation with the compression provided by the flap 511 or filled flap 1001 to trap the o-ring 602 of the inner glove 601 proximal to the ridge 1003 and prevent removal or partial removal of the inner glove 601 in a manner that would break moisture sealing and thus sterility of the environment. The ridge 1003, in some embodiments, can be constructed of a same material as the sleeve 501 and/or the flap 511 or filled flap 1001. In addition, in some embodiments, the ridge 1003 can be filled similar to the filled flap in order to provide additional height/thickness. It will also be apparent in view of this disclosure that, in some embodiments, such as, for example, where it is preferably for the ridge 1003 to be more rigid than the sleeve 501 or the flap 511 or filled flap 1001, the ridge 1003 can also be constructed of other materials such as, for example, rubber, plastic, polymers, surgical stainless steel, combinations thereof, or any other suitable material.

In some embodiments, the flap 511 or filled flap 1001 can also include one or more pull tabs (not shown) in order to facilitate gripping of the flap 511 or filled flap 1001 when turning down (distally) over the inner glove 601 and o-ring 602. In some embodiments, the user can also place a rubber/elastic band or adjustable strap (e.g., an adjustable strap having hook and loop fasteners disposed thereon) to further compress the flap 511 or filled flap 1001 against the inner glove 601 and o-ring 602 to decrease or eliminate fluid/moisture from crossing the glove down interface. In some embodiments, a glue, tape, or adhesive can be applied or attached to the exterior of the sleeve 501, the exterior of the weld 513 and/or an exterior surface of the flap 511 or filled flap 1001 ("exterior surface" referring to the surface that is facing away from the user's arm when the flap 511 or filled flap 1001 is in the turned down position) so as to further prevent distal roll-back or slippage of the inner glove 601.

While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications or modifications of the disclosure.

What is claimed is:

1. An integrated fluid management system comprising:

a garment, comprising a sleeve extending from a shoulder portion of the garment at a proximal end to a wrist portion at a distal end, the sleeve having an interior surface and an exterior surface;

a wicking layer at least partially attached to the interior surface of the sleeve and extending through the wrist portion, including from the wrist portion proximally toward the shoulder portion along the interior surface of the sleeve and adapted to extend from the wrist portion distally toward the hand of a wearer to form a hand portion including;

a thumb loop sized for insertion of a thumb therethrough, and a palm draping extending between the thumb loop and the wrist portion, the palm draping sized and shaped to cover a heel of the hand;

a flap having a first end, a second end, an interior flap surface, an unfolded position, and a folded position, wherein:

the first end is attached by a seaming cuff weld to the sleeve of the garment and the second end is not attached to the sleeve of the garment, the flap movable from the unfolded position, wherein the second end is located proximal to the first end, and the folded position, wherein the second end is located distal to the first end, wherein the first end of the flap is attached at a location along the sleeve such that, in the folded position, the second end is located along the sleeve proximal to and spaced apart from the wrist portion;

a first protective glove configured to be worn over a hand and wrist of a user, wherein the unfolded position of the flap permits positioning of a first O-ring of the first protective glove around the exterior surface of the sleeve distal to the first end of the flap and further wherein, in the folded position, the flap is sized to cover the first O-ring such that the first O-ring is sandwiched between the interior flap surface of the flap and the exterior surface of the sleeve of the garment; and a second protective glove configured to be worn over the first protective glove and over the flap in the folded position such that a second O-ring of the second protective glove is located proximal to the first O-ring and the flap in the folded position, and wherein the second end of the flap, when in the folded position, is sandwiched between the first glove and the second glove.

2. The system of claim 1, wherein the sleeve comprises an impervious material.

3. The system of claim 2, wherein the impervious material includes at least one of nonwoven materials, polypropylene, polyester, polyethylene, or combinations thereof.

4. The system of claim 1, wherein the wicking layer comprises wool, bamboo, or a micromodal fabric, or a combination of two or more of wool, bamboo and micromodal fabric.

5. The system of claim 1, wherein the first end of the flap is attached to the exterior surface of the sleeve such that an exterior flap surface, opposite the interior flap surface, is attached to the exterior surface of the sleeve.

6. The system of claim 5, wherein, in the folded position, the flap forms a joint with the seaming cuff weld, the joint protruding radially outward from the exterior surface of the sleeve.

7. The system of claim 6, wherein the joint is adapted to be positioned distal to the second O-ring of the second protective glove to impede distal movement of the second O-ring of the second protective glove along the sleeve.

8. The system of claim 1, wherein the seaming cuff weld is formed by at least one of thermal seaming, chemical seaming, mechanical seaming, welding, glue, other adhesives, adhesive tapes, or combinations thereof.

9. The system of claim 1, wherein the wicking layer extends through an entire length of the sleeve between the wrist portion and the shoulder portion.

10. The system of claim 9, wherein the wicking layer is attached to the interior surface of the sleeve at least at the wrist portion, the shoulder portion, or both.

11. The system of claim 9, wherein the wicking layer is laminated to the interior surface of the sleeve.

12. The system of claim 1, wherein a side of the thumb loop opposite the palm draping is adapted to extend directly back to the wrist portion without covering a back of the wearer's hand.

13. The system of claim 2, wherein the flap is constructed of a second impervious material having a higher coefficient of friction than the impervious material of the sleeve.

14. The system of claim 13, wherein the flap is constructed of at least one of Thermoplastic Polyurethane (TPU), rubber, or combinations thereof.

15. An integrated fluid management system comprising:

a garment, comprising a sleeve extending from a shoulder portion of the garment at a proximal end to a wrist portion at a distal end, the sleeve having an interior surface and an exterior surface, and the wrist portion having an opening configured to allow a wearer's hand to extend therethrough;

a flap having a first end, a second end, an interior flap surface, an unfolded position, and a folded position, wherein:

the first end is attached to the sleeve of the garment and the second end is not attached to the sleeve of the garment, the flap movable from the unfolded position, wherein the second end is located proximal to the first end, and the folded position, wherein the second end is located distal to the first end, wherein the first end of the flap is attached at a location along the sleeve such that, in the folded position, the second end is located along the sleeve proximal to and spaced apart from the wrist portion;

a first protective glove configured to be worn over a hand and wrist of a user, wherein the unfolded position of the flap permits positioning of a first O-ring of the first protective glove around the exterior surface of the sleeve distal to the first end of the flap and further wherein, in the folded position, the flap is sized to cover the first O-ring such that the first O-ring is sandwiched between the interior flap surface of the flap and the exterior surface of the sleeve of the garment; and a second protective glove configured to be worn over the first protective glove and over the flap in the folded position such that a second O-ring of the second protective glove is located proximal to the first O-ring and the flap in the folded position, and wherein the second end of the flap, when in the folded position, is sandwiched between the first glove and the second glove.

16. The system of claim 15, further comprising a wicking layer at least partially attached to the interior surface of the sleeve and extending through at least the wrist portion, wherein the wicking layer comprises wool, bamboo, or a micromodal fabric, or a combination of two or more of wool, bamboo and micromodal fabric.

17. The system of claim 15, wherein the first end of the flap is attached to the exterior surface of the sleeve such that an exterior flap surface, opposite the interior flap surface, is attached to the exterior surface of the sleeve by a seaming cuff weld.

18. The system of claim 17, wherein, in the folded position, the flap forms a joint with the seaming cuff weld, the joint protruding radially outward from the exterior surface of the sleeve.

19. The system of claim 18, wherein the joint is adapted to be positioned distal to the second O-ring of the second protective glove to impede distal movement of the second O-ring of the second protective glove along the sleeve.

20. The system of claim 17, wherein the seaming cuff weld is formed by at least one of thermal seaming, chemical seaming, mechanical seaming, welding, glue, other adhesives, adhesive tapes, or combinations thereof.

* * * * *